US010751255B2

(12) United States Patent
Dierckx et al.

(10) Patent No.: US 10,751,255 B2
(45) Date of Patent: Aug. 25, 2020

(54) ASEPTIC HARD CAPSULE SEALING APPARATUS AND METHODS

(71) Applicant: Capsugel Belgium NV, Bornem (BE)

(72) Inventors: Tarryn Dierckx, Deurne (BE); Gunther Van Goolen, Hombeck (BE); Stefaan Jaak Vanquickenborne, Rijmenam (BE)

(73) Assignee: Capsugel Belgium NV, Bornem (BE)

( * ) Notice: Subject to any disclaimer, the term of this patent is extended or adjusted under 35 U.S.C. 154(b) by 150 days.

(21) Appl. No.: 16/085,920

(22) PCT Filed: Mar. 8, 2017

(86) PCT No.: PCT/IB2017/051364
§ 371 (c)(1),
(2) Date: Sep. 17, 2018

(87) PCT Pub. No.: WO2017/158473
PCT Pub. Date: Sep. 21, 2017

(65) Prior Publication Data

US 2019/0110955 A1 Apr. 18, 2019

(30) Foreign Application Priority Data

Mar. 15, 2016 (EP) ..... 16160324

(51) Int. Cl.
*A61J 3/07* (2006.01)

(52) U.S. Cl.
CPC ..... *A61J 3/072* (2013.01)

(58) Field of Classification Search
CPC .. A61J 3/072; B29C 65/548; B29C 66/83221; B65B 29/022
(Continued)

(56) References Cited

U.S. PATENT DOCUMENTS 2,279,505 A * 4/1942 Ravenscroft ..... A61J 3/07 53/451
4,257,562 A * 3/1981 Zini ..... A24C 5/24 118/610
(Continued)

FOREIGN PATENT DOCUMENTS

EP 0116743 8/1984
EP 0116744 8/1984
(Continued)

OTHER PUBLICATIONS

International Search Report and Written Opinion for PCT/IB2017/051364 (dated Apr. 24, 2017).
(Continued)

*Primary Examiner* — Stephen F. Gerrity
*Assistant Examiner* — Joshua G Kotis
(74) *Attorney, Agent, or Firm* — Klarquist Sparkman, LLP

(57) ABSTRACT

An apparatus for aseptic sealing a capsule having coaxial parts that at least partly overlap when telescopically joined, certain embodiments of the apparatus comprising: a capsule carrier assembly provided with at least one cavity for accommodating a respective capsule therein; a clamping member comprising a first half and a second half disposed on either side of the cavity at a capsule processing station, and each half arranged to linearly displace towards the cavity containing the capsule to a clamped position over and/or around at least a portion of the capsule; wherein the clamping member comprises a sealing means adapted to apply a sealing fluid uniformly to a circumferential gap around the capsule to be sealed when in the clamped position, and wherein the clamping member further comprises a suction means adapted to provide an area of low pressure around the capsule after application of the sealing
(Continued)

fluid so as to remove any excess sealing fluid from the capsule when in the same clamped position.

18 Claims, 9 Drawing Sheets

(58) Field of Classification Search
USPC ..... 424/454; 53/900, 383.1; 156/69
See application file for complete search history.

(56) References Cited

U.S. PATENT DOCUMENTS

| | | | | |
|---|---|---|---|---|
| 4,539,060 | A * | 9/1985 | Wittwer | B29C 65/4895 156/275.1 |
| 4,724,019 | A * | 2/1988 | Brown | A61J 3/072 156/69 |
| 4,844,760 | A * | 7/1989 | Dickey | B65C 3/16 156/215 |
| 4,899,516 | A * | 2/1990 | Krieger | A61J 3/072 118/317 |
| 4,940,499 | A | 7/1990 | Lebrun et al. | |
| 4,991,377 | A * | 2/1991 | Marchesini | A61J 3/072 156/69 |
| 5,617,710 | A * | 4/1997 | Goossens | A61J 3/072 53/281 |
| 5,819,508 | A * | 10/1998 | Kraft | B67B 7/02 53/492 |
| 6,871,566 | B2 * | 3/2005 | Niwayama | B67B 7/182 53/381.4 |
| 6,949,154 | B2 * | 9/2005 | Hochrainer | A61J 3/072 156/272.8 |
| 7,645,407 | B2 | 1/2010 | Cade et al. | |
| 8,181,425 | B2 | 5/2012 | McCutcheon et al. | |
| 2005/0223682 | A1 * | 10/2005 | Sung | B65B 31/046 53/512 |
| 2011/0247302 | A1 * | 10/2011 | Cade | A61J 3/072 53/285 |

FOREIGN PATENT DOCUMENTS

| | | |
|---|---|---|
| EP | 0180543 | 5/1986 |
| EP | 1072245 | 1/2001 |
| EP | 1459725 | 9/2004 |
| EP | 3219300 | 9/2017 |
| EP | 3560477 | 10/2019 |
| JP | 2019508157 | 3/2019 |
| WO | WO2004/082563 | 9/2004 |
| WO | WO2007/017725 | 2/2007 |
| WO | WO2008/015519 | 2/2008 |
| WO | WO2017/158473 | 9/2017 |

OTHER PUBLICATIONS

Office Action for European Patent Application No. 16160324.6 (dated Aug. 12, 2016),.
Office Action for European Patent Application No. 16160324.6 (dated Jan. 1, 2018).
Office Action for European Patent Application No. 16160324.6 (dated May 30, 2018).

* cited by examiner

ASEPTIC HARD CAPSULE SEALING APPARATUS AND METHODS

CROSS REFERENCE TO RELATED APPLICATIONS

This is the U.S. National Stage of International Application No. PCT/IB 2017/051364, filed Mar. 8, 2017, which was published in English under PCT Article 21(2), which in turn claims the benefit of European Patent Application No. 16160324.6, filed Mar. 15, 2016, which are incorporated herein in their entireties.

FIELD

The present disclosure relates to apparatuses and methods for sealing of capsules, typically hard capsules, for the delivery of one or more medicaments or other active materials. Such sealing may be useful in preventing leakage of the contents of the capsule (particularly for liquid fill applications) or may further provide tamper resistance thereof.

BACKGROUND

Capsule technology continues to be subject to development and improvements. In its basic form, standard containers for pharmaceuticals or other powdered, granular or liquid substances (generally referred to as telescope-type or two-piece capsules or hard capsules) include a tubular-shaped and/or cylindrically-shaped first part, namely a cap part, which is closed on one end and open on the other opposite end. A tightly fitting second part of similar shape, namely the body part, is of smaller diameter than the cap part and is typically telescopically engaged therein to form the overall dosage form or two-piece capsule. Similar capsule technology may be used to generate multi-compartment capsules.

Sealing of capsules of the above type has been implemented mainly to allow storing of liquids within such capsules and preventing leakage there through.

EP 0 116 743 A1, EP 0 116 744 A1 and EP 0 180 543 A1 exemplify methods and devices for sealing such capsules having hard shell coaxial cap and body parts which overlap when telescopically joined. The process employed comprises the steps of dipping batches of the capsules randomly oriented in mesh baskets or oriented with their cap parts upright into a sealing fluid making capillary action within the overlap of the cap and body parts or spraying the sealing fluid or steam thereof onto the seam of the overlap, removing the sealing fluid from the surface of the capsules by an air blower, and applying thermal energy to the capsules while conveying the baskets through a dryer. The documents disclose the use of a wide range of sealing fluids and specific temperatures and modes of application of thermal energy.

Other state of the art equipment and methods, as exemplified in U.S. Pat. No. 4,940,499B, include the application of a sealing liquid by a series of angled nozzles whilst respective capsules are maintained in an inverted (i.e. cap down) orientation to enable the sealing liquid to penetrate the circumferential gap (also referred to herein as cap/body interface) via the combined gravitational and wicking effects.

Furthermore, EP 1 072 245 A1 exemplifies a method for sealing telescopically joined capsules with coaxial body parts through subsequent application of a sealing liquid by the overlapping region at the joint between a cap and a body, the removal of excess sealing liquid, and the application of thermal energy for drying purposes. This document particularly describes the steps of applying a sealing liquid including a solvent uniformly to the external edge of the gap of a capsule to be sealed to form a liquid ring around the circumference of the capsule, removing excess sealing liquid from the exterior of the capsule and drying the capsule by applying thermal energy from outside while gently tumbling and conveying the capsule on a spiral path. Spray nozzles are used for individually applying the sealing liquid. The excess solution is removed from around the capsule by vacuum suction or air jets.

In order to address some of the problems of the prior art, particularly associated with the partly imperfect quality of the seal and the difficulty to control process parameters influencing the quality of the seal, sealing clamp systems have been adopted (as exemplified in EP1459725A1). The aim of such systems was to improve the fluid injection phase in order to reach the maximum volume available in the overlap of the body parts while the capsule remains free of residual liquid on its surface. The above has been achieved by implementing a rotating clamp to maintain the capsule in an upright position when a sealing liquid is injected.

Although the above described state of the art equipment and methods have shown some incremental successes in overall sealing of hard capsules, they are yet unsuitable for processing (e.g. sealing) in aseptic applications.

Thus, there still remains a need for an apparatus and method that specifically and effectively enable aseptic sealing of hard capsules, particularly for example in biological/bacterial liquid filling of capsules.

SUMMARY

In a first aspect, the disclosure relates to an apparatus for aseptic sealing a capsule having coaxial parts that at least partly overlap when telescopically joined, the apparatus comprising: a capsule carrier assembly provided with at least one cavity for accommodating a respective capsule therein; a clamping member comprising a first half and a second half disposed on either side of the cavity at a capsule processing station, and each half arranged to linearly displace towards the cavity containing the capsule to a clamped position over and/or around at least a portion of the capsule; wherein the clamping member comprises a sealing means adapted to apply a sealing fluid uniformly to a circumferential gap around the capsule to be sealed when in the clamped position, and wherein the clamping member further comprises a suction means adapted to provide an area of low pressure around the capsule after application of the sealing fluid so as to remove any excess sealing fluid from the capsule when in the same clamped position In a second aspect, the disclosure relates to a method of aseptic sealing of hard capsules.

In a third aspect, the disclosure relates to the use of an apparatus for aseptic sealing of hard capsules.

DETAILED DESCRIPTION

By the term "a" and/or "an" when describing a particular element, it is intended "at least one" of that particular element.

By the term "medicament", it is intended a "drug" or the like comprising one or more compounds providing one or more curative benefits to a subject, the terms "medicament" and "drug" may be used interchangeably herein.

By the term "hard shell" or "hard capsule shell", it is intended a shell that is deformable, but which returns to its un-deformed shape upon the removal of a deforming force. Typically such shells comprise less than 25%, or less than 20%, or from 0% to 14%, or from greater than 0% to less than 14%, water by weight.

By the term "aseptic sealing", it is intended that the sealing may be performed in low-bioburden or sterile conditions. Typically meaning that equipment components and process are designed such that the entire area into which the capsules are exposed may be completely sterilized (and sterilizable) and made substantially free of micro-organisms, including bacteria, grease and the like.

By the term "capsule length", unless expressly otherwise indicated, means the length parallel to an axis crossing both capsule cap and capsule body when telescopically joined and when resting within the cavity of the carrier, generally along a capsule axis L.

As used herein, the "x-axis" or "x axis" refers to an axis perpendicular to the capsule axis L, the "y-axis" or "y axis" is parallel to the capsule axis L, and the "z-axis" or "z axis" is perpendicular to the x and y axis (as illustrated in the exemplary figures).

Various embodiments will now be described to provide an overall understanding of the principles of the structure, function, manufacture, and use of apparatus and methods disclosed herein. One or more examples of these embodiments are illustrated in the accompanying figures. Those of ordinary skill in the art upon reading of this disclosure will understand that features described or illustrated in connection with one example embodiment in certain instances can be combined with the features of other example embodiments without generalization from the present disclosure.

Apparatus

Figure 1:
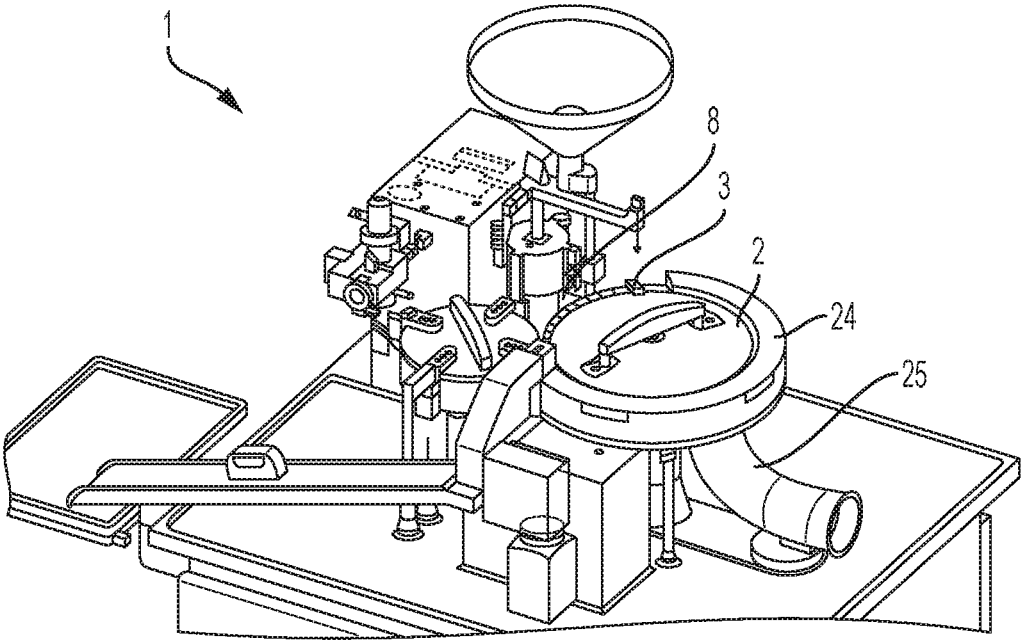
FIG. 1 is an isometric/perspective view of an apparatus according to an embodiment herein.
Figure 2:
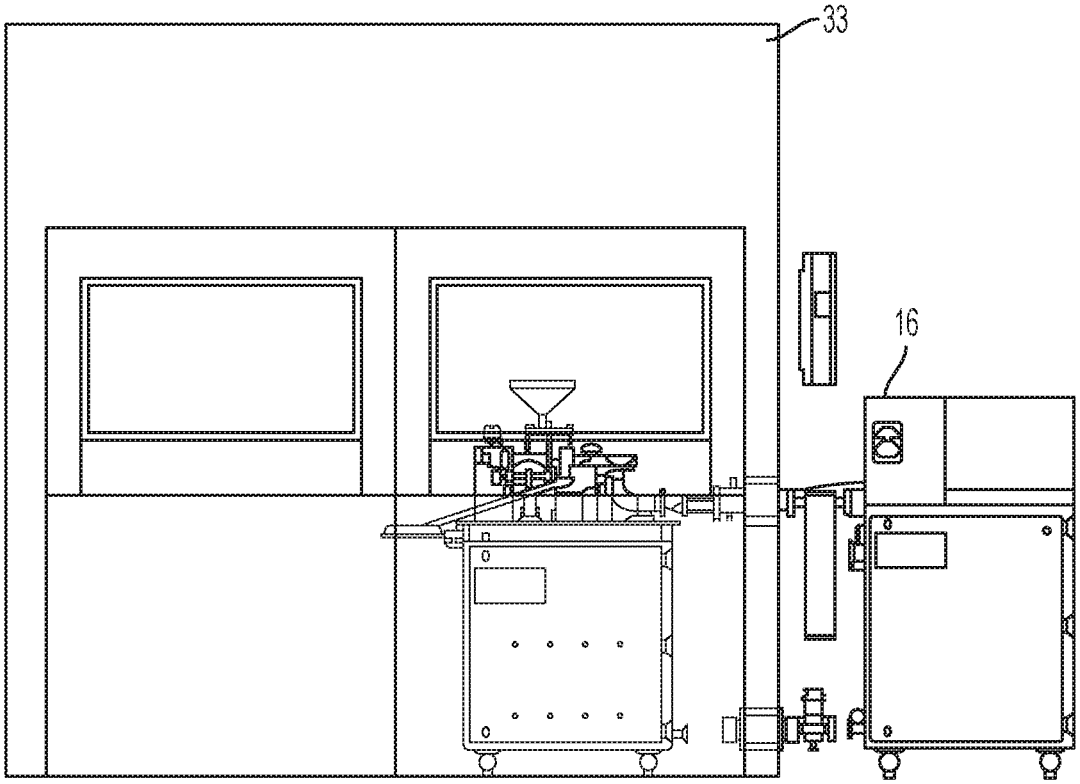
FIG. 2 is a side view of an apparatus according to an embodiment herein.
Figure 3:
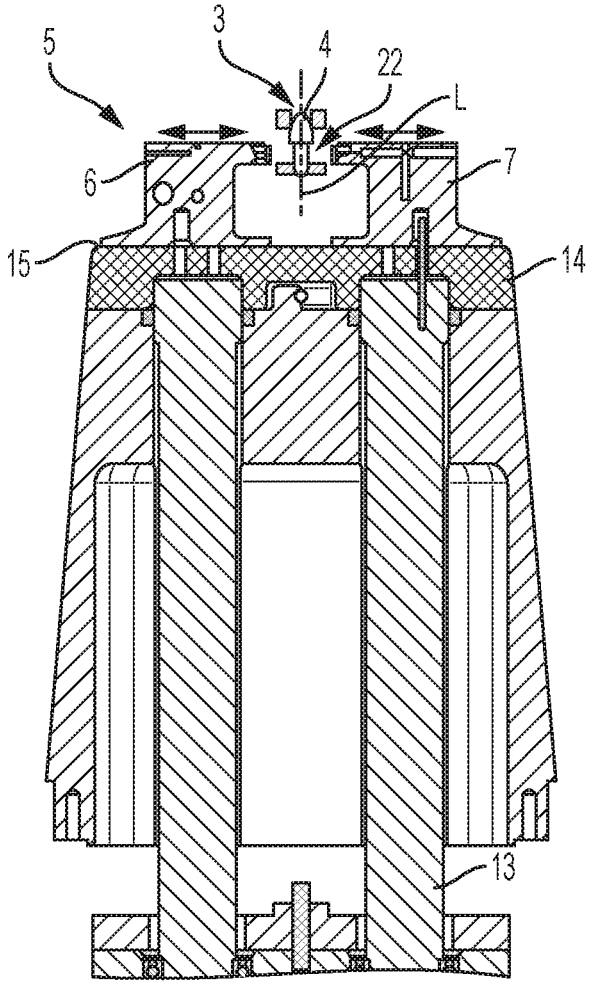
FIG. 3 is a part section view of a processing station according to an embodiment herein.
Figure 4:
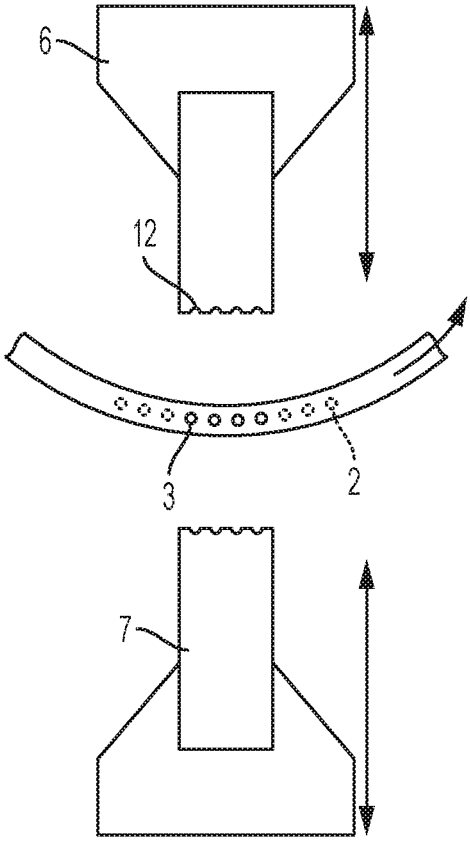
FIG. 4 is a schematic top view illustrating the positioning of the clamping member and capsule carrier according to an embodiment herein.
Figure 5:
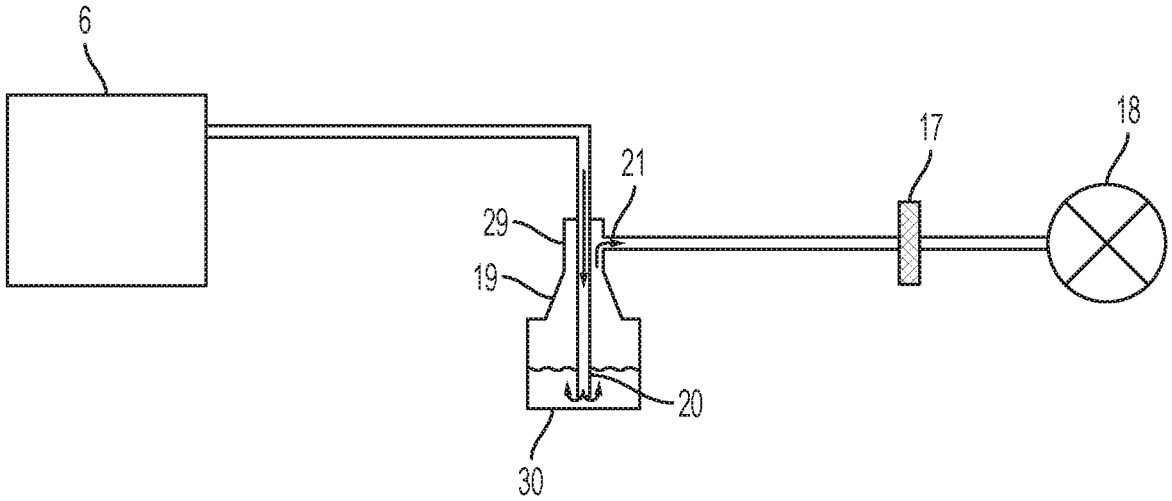
FIG. 5 is a schematic illustration of a suction means arrangement according to an embodiment herein.
Figure 6:
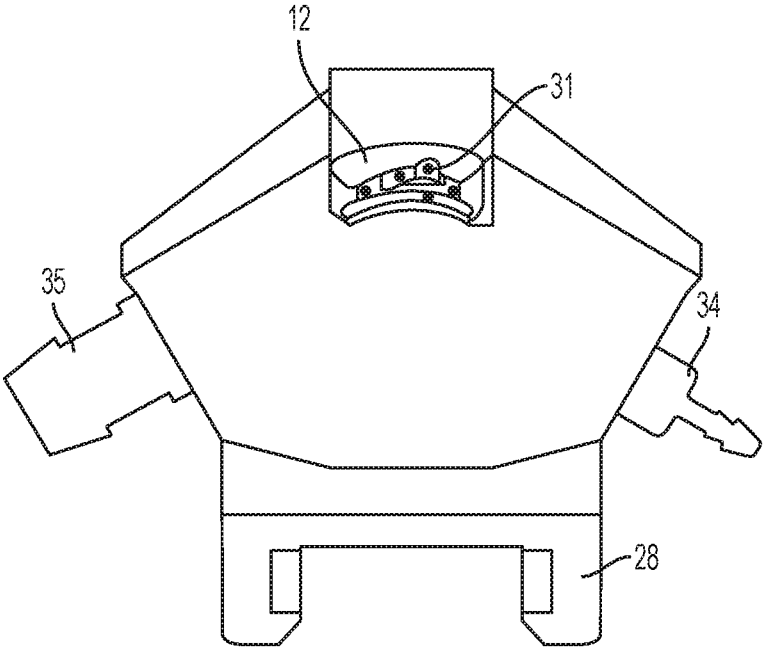
FIG. 6 is an isometric/perspective view of a (half) clamping member according to an embodiment herein.
Figure 7:
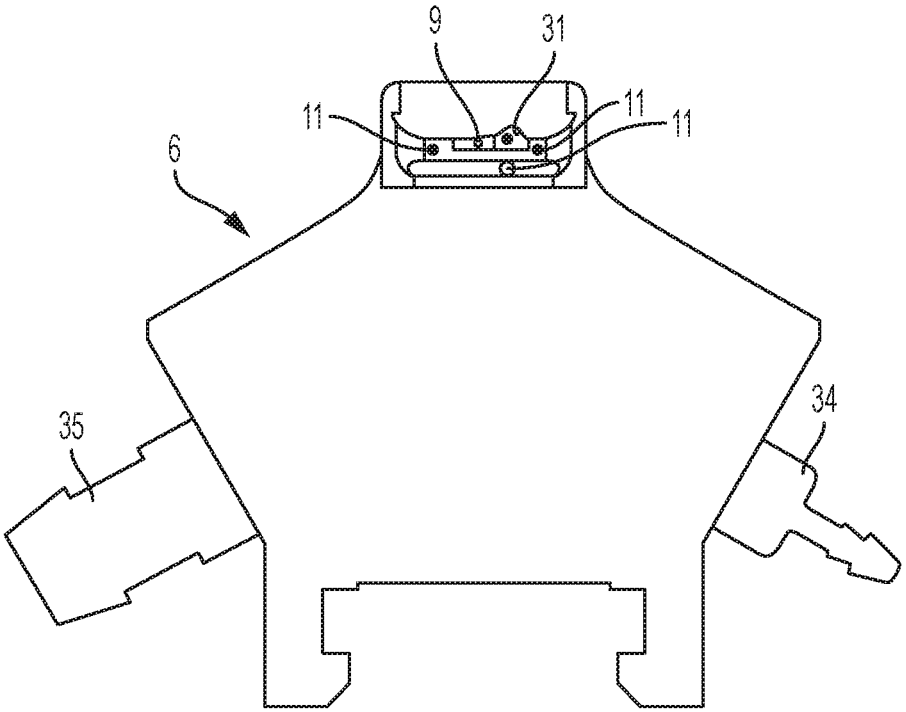
FIG. 7 is a front view of the (half) clamping member of FIG. 6.
Figure 8:
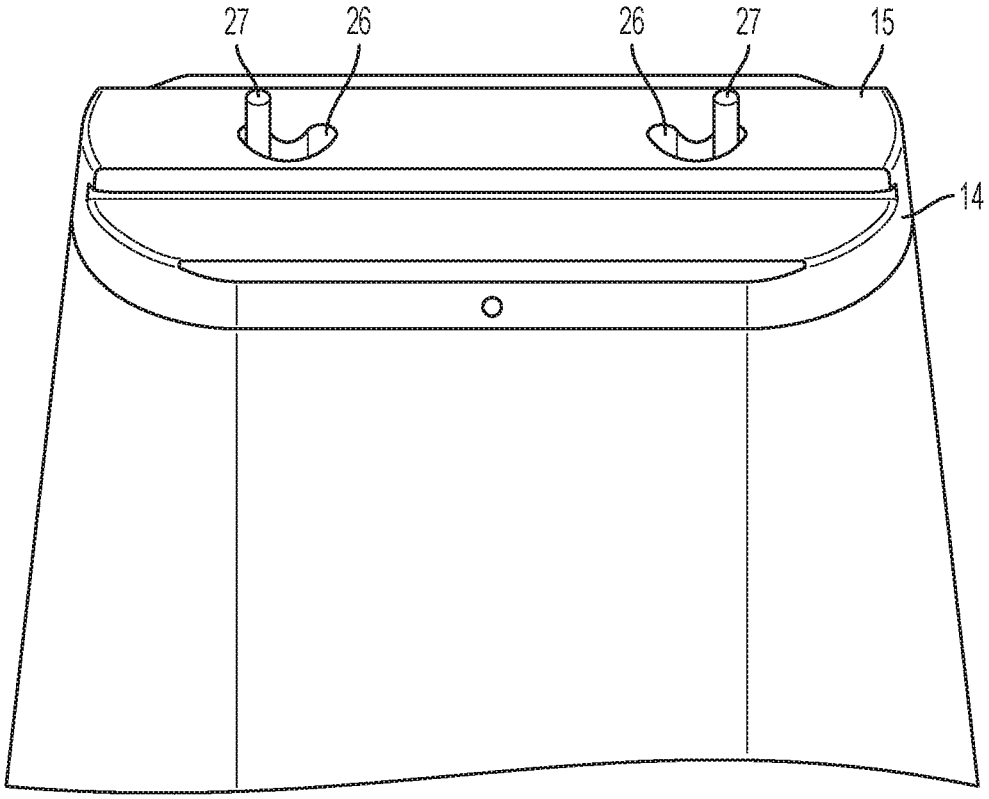
FIG. 8 is an isometric/perspective view of a rail member assembly according to an embodiment herein.
Figure 9A:
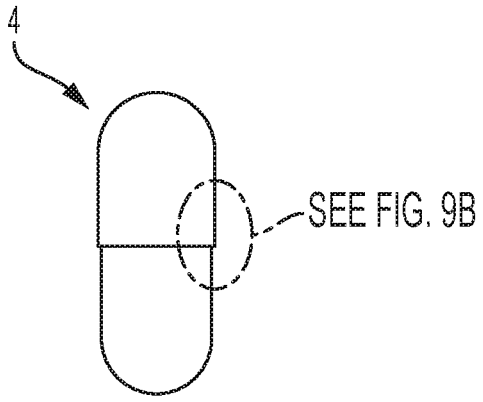
FIGS. 9A and 9B are schematic illustration of a telescopic capsule having a gap at the cap/body interface according to an embodiment herein.
Figure 9B:
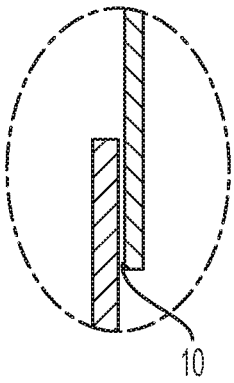

The apparatus according to the present disclosure is described in the following passages with reference to exemplary FIGS. 1 to 9B.

The present disclosure relates to an apparatus 1 for aseptic sealing a capsule having coaxial parts that at least partly overlap when telescopically joined, the apparatus comprising: a capsule carrier assembly 2 provided with at least one cavity 3 for accommodating a respective capsule 4 therein; a clamping member 5 comprising a first half 6 and a second half 7 disposed on either side (preferably opposite sides generally symmetrically disposed over an axis perpendicular to a capsule axis L) of said cavity 3 at a capsule processing station 8, and each said half 6,7 arranged to linearly displace towards said cavity 3 containing said capsule 4 to a clamped position over and/or around at least a portion of said capsule 4, preferably such that said capsule is at least circumferentially enclosed within said clamping member 5; wherein said clamping member 5 comprises a sealing means (also referred to herein as "sealing mechanism") 9 adapted to apply a sealing fluid (typically in the form of a liquid such as an aqueous composition comprising one or more organic solvents and optionally one or more adhesive additives) uniformly to a circumferential gap 10 around said capsule 4 to be sealed when in said clamped position, and wherein said clamping member 5 further comprises a suction means (also referred to herein as "suction mechanism") 11 adapted to provide an area of low pressure around said capsule 4 after application of the sealing fluid so as to remove any excess sealing fluid from said capsule 4 when in said same clamped position. Surprisingly it has been found that such particular arrangement allows for effectively limiting and even negating residual of bacterial formation and/or build up as well as providing a contained system that permits effective sterilization thereof.

Generally the first and second halves 6,7 of the clamping member 5 are substantially identical to one another and may be symmetrically disposed (or mirrored) on either side of the respective cavity 3 of the carrier 2.

In an embodiment, each first and second half 6,7 of the clamping member 5 comprises a sealing fluid inlet port 34 and a vacuum port 35, wherein the sealing fluid inlet port 34 is in fluid communication with the sealing means 9 (in particular the sealing fluid nozzles) and wherein the vacuum port 35 is in fluid communication with the suction means 11 (in particular the vacuum nozzles), typically via one or more fluid channels within the clamping member 5. Each said first and second half 6,7 being arranged to permit sanitization of each said channels via flushing of a sanitizing fluid (such as a hydrogen peroxide comprising composition) there through.

In an embodiment, the suction means 11 is adapted to apply a further suction force after the clamp member halves 6,7 are moved to a de-clamped (or un-clamped) position, typically after application and removal of the sealing fluid. Such arrangement has been found useful to further ensure that any residual sealing fluid on a clamp member surface is completely removed prior to clamping and sealing the subsequent capsule. In certain embodiments, said suction force is greater than said low pressure during sealing fluid removal in the clamped position.

In an embodiment, the capsule carrier assembly 2 comprises a plurality of cavities 3 for accommodating respective capsules 4 therein and each first and second half 6,7 of the clamping member 5 comprises a plurality of concave recesses 12 each arranged to accommodate a portion of the capsule surface therein such that when the clamping member 5 is in its fully closed clamped position a plurality of capsules are circumferentially enclosed within said clamping member 5, in certain embodiments wherein the number of concave recesses 12 of each said half 6,7 is at least 3, or at least 4. Alternatively, a person skilled in the art would understand that a plurality of clamp members as described herein may be equally utilized, although resulting in a more complex system and further increasing the number of moving parts further requiring sanitization.

In an embodiment, each said cavity 3 is in fluid communication with a drying source arranged to provide a drying fluid to the capsule stored therein, generally through an air duct 25. Typically, the drying source is arranged to provide an air, in certain embodiments warm air (i.e. from 25° C. to 40° C.), flow through one or more conduits within the carrier to each cavity. The carrier 2 may be arranged such that the drying fluid is allowed to flow to a respective cavity 3 only after leaving the capsule processing station 8 and entering a capsule fusion station arranged to fuse the capsule shells to provide a fully sealed capsule. The fusion station may be arranged to extend radially along the circumference of said carrier through an arc of at least 90°, or at least 100°, or from 120° to 300°, or from 150° to 250°. These arrangements have been found to effectively promote fusion and/or sealing of each capsule after the sealing fluid is applied and excess fluid evacuated in a fast and effective manner without affecting the mechanical integrity of the sealed capsules.

The carrier assembly 2 may be substantially circular in form and rotatable about an axis parallel to the capsule axis L. The carrier 2 may further be arranged such that each cavity 3 contains a respective capsule 4 in an upright position and exposes an overlap surface (generally proximal to a gap 10) of the capsule cap over the capsule body for contact with respective clamping member 5.

In an embodiment, the linear displacement of the clamping member 5 is provided by a combination of a rotational drive 13 and a rail member 14 that converts a rotational movement to a linear movement along a rail 15 of said rail member 14. In certain embodiments, the rail member being disposed between the clamping member and the rotational drive and typically arranged such that decoupling of the clamping member is attained by vertical displacement of the rail member (by vertical displacement it is intended an upwardly displacement of the referred components along an axis perpendicular to the direction of linear displacement of the clamp member halves towards the carrier cavity, i.e. an upwardly displacement along an axis parallel to the capsule axis L).

In an embodiment, the rail member 14 comprises at least two curvilinear elongated openings (also referred to as "first slots") 26 for allowing respective portions of the rotational drive (typically a portion of shafts 27 thereof) to directly couple to each half of the clamp member 5. The shafts 27 may couple to complementary recesses located on a base of each clamp half. It has been found that this arrangement provides a very efficacious way of converting the rotational motion of the drive into a linear motion of the clamp halves, thus enabling improved containment of the parts as well as simple and effective removal thereof for further sanitization. Such arrangement has been found to further limit and simplify the amount of sealing required to prevent contamination in/out of the capsule handling surfaces.

In an embodiment, the rail member 14 comprises at least two first slots through which a portion of the rotational drive extends in order to engage with each respective clamp half 6,7 via at least two second slots located at a bottom face of each respective clamp half 6,7 arranged to accommodate said respective portion of the rotational drive, and wherein the first and second slots are elongated in shape with the longest side of the first slots being substantially perpendicular to the longest length of the second slots (by "substantially perpendicular" as used herein it is intended to exclude a parallel arrangement, and typically includes arrangements wherein the longest length of the first slot is at an angle alpha to the longest length of the second slot and angle alpha being from 10° to 120°, or from 40° to 100°, or about 90°), in certain embodiments wherein the first slots are curvilinear and typically forming an arch-like or semi-circular curve along the longest length thereof (the second slots in certain embodiments being linear in shape and extending linearly along the longest length thereof). An advantage of this arrangement is the provision of a compact, simple and effective system for converting the rotational movement to a linear movement whilst minimizing the number of parts needed as well as providing quick release capabilities.

In an embodiment, each half of the clamping member comprises a gliding member 28, in certain embodiments hook shaped, slidably connectable to the rail member 14. The gliding member 28 may be a single part with the clamping member 5. In these embodiments, the clamp member halves are removed by first decoupling the rail member from the drive by vertical displacement, followed by sliding out the clamp member halves therefrom.

In an embodiment, the sealing fluid is provided to the clamping member 5 sealing mechanism by a pump in certain embodiments comprising or consisting of a peristaltic pump. An advantage of this arrangement is to further prevent bacterial deposition/formation on moving pump parts, and thus allow complete sterilization also of the pumping surfaces.

In an embodiment, the suction means 11 comprises one or more vacuum nozzles on a surface of the clamping member 5 in fluid communication with a vacuum source 18 and a filter 17, typically wherein said filter is a high-efficiency particulate arrestance (HEPA) filter in certain embodiments hydrophobically treated for reducing the affinity to water.

The apparatus described herein may further comprise a liquid collection reservoir 19 in fluid communication with the one or more vacuum nozzles and the vacuum source 18, wherein said liquid collection reservoir 19 comprises an inlet 20 and an outlet 21, said inlet 20 being downstream the one or more suction nozzles and the outlet 21 being upstream the filter 17, said reservoir 19 typically being arranged to collect and retain the sealing liquid sucked through the one or more suction nozzles, generally under gravitational effect, in certain embodiments wherein said reservoir is removable and/or disposable.

In a preferred embodiment, the reservoir comprises a neck 29 and an oppositely disposed base 30, and is arranged such that said inlet 20 is proximal to said base 30 and said outlet 21 is proximal to said neck 29 and distal from said base 30. This arrangement allows for more effectively ensuring all liquid state sealing fluid remains at the bottom of the reservoir (proximal to the base thereof) under the effects of gravity whilst the gas state components are further evacuated through the outlet and towards the filter via the vacuum source under pressure effect. Such arrangement has been found beneficial for better attaining low bio-burden sealing.

In an embodiment, the cavity 3 has open sides 22 to expose a portion of the capsule 4 such that each half 6,7 of the clamping member 5 can wrap around a circumferential surface of the capsule 4, typically so that once in the clamped position the full circumference of the capsule 4, over at least a portion of the capsule length (along the capsule axis L), is enclosed within said clamping member 5.

In an embodiment, the apparatus comprises one or more pushers for manipulation of the capsules (such as opening pre-locked capsules to a filling position and closing of the filled capsules prior to sealing). Each such pusher comprising bellow seals for sealing said pushers throughout a pusher stroke.

In an embodiment, the clamping member 5 is slidably connected to a rotational drive 13 via a rail member 14 arranged such that said clamping member 5 can be decoupled from said drive by vertical displacement thereof.

In an embodiment the rail member is made of a plastic or ceramic material compatible with sanitizing fluids.

In certain embodiments, each clamping member half 6,7 consists of a single component typically made of a material resistant to elevated temperatures (above 110° C.) and sanitizing fluids (such as hydrogen peroxide), exemplary materials include metals (like stainless steel) or ceramics.

In a preferred embodiment, both sealing and suction occur at the same position without further translating the capsule to different positions. Such allows to limit bio-burden effects and potential contamination of subsequent capsule processing.

In an embodiment, the sealing means 9 comprises one or more sealing fluid nozzles in fluid communication with a sealing fluid source, and the suction means 11 comprises a plurality of vacuum nozzles in fluid communication with a vacuum source, wherein said sealing fluid and vacuum nozzles are circumferentially spaced around each first half 6 and a second half 7 of the clamping member 5, in certain embodiments wherein the number of vacuum nozzles is greater than the number of sealing fluid nozzles.

In a preferred embodiment, each clamp half 6,7 comprises a single fluid nozzle and a plurality of vacuum nozzles.

In a preferred embodiment, the sealing means 9 comprises a cap-edge sealing member 31 geometrically shaped to allow a droplet of sealing fluid to form at a predetermined position on the clamping member surface for wicking/capillarity through the gap 10 (i.e. a capsule cap/body interface) via capillary effects. Typically said shape comprises hook-shaped cavity (making a droplet reservoir), generally such shape allowing to collect a larger droplet (generally by "larger" meaning an agglomerated single droplet, the effect of which has been found to aid in preventing over-wetting the capsule and more effectively promoting filling the entire gap via such capillarity) of sealing fluid which is then absorbed and distributed through the gap 10 by capillary action. In certain embodiments, at least one vacuum nozzle is positioned proximal to an apex of the hook-shaped surface and at least one sealing fluid nozzle is radially positioned therefrom. It has been surprisingly found that such particular geometrical arrangement allows for correct and predetermined sealing fluid application to the capsule surface and also further optimal evacuation/removal of any excess fluid after completion of the sealing step.

In a preferred embodiment, each half of the clamp member comprises at least 3, or at least 4, vacuum nozzles. Typically said vacuum nozzles being radially (i.e. along a radius extending about a plane substantially perpendicular to the capsule axis L) distributed along the clamping surface and in certain embodiments at least two of the nozzles being further axially separated along an axis parallel to the capsule axis L. In one embodiment, at least one of the vacuum nozzles is positioned within a body ring groove, and generally has a greater orifice diameter compared to the rest of the vacuum nozzles. This arrangement has been found particularly beneficial in effectively removing any excess sealing fluid for limiting contamination thereafter.

In a preferred embodiment, the capsule carrier 2 is rotatably mounted to a stationary frame 24, the apparatus comprising a plurality of capsule handling stations that may be angularly positioned from one another, and wherein one of said stations is the capsule processing station being a single combined sealing-and-suction station comprising the clamping member; in certain embodiments wherein the sealing-and-suction station is positioned between a capsule loading station and a capsule ejection station.

In an embodiment, each component of the apparatus functioning in direct proximity to capsule handling operations, said operations at least selected from capsule loading, capsule sealing, and capsule ejection and including all positions therebetween, are removable and are either fully sealed or free of any lubricating parts or thread comprising fasteners.

In an embodiment, the apparatus may further comprises an aseptic containment enclosure and/or cabinet 33 into which capsule processing components and stations of the apparatus are contained. Said enclosure and/or cabinet 33 typically comprising an air filtration system and sterilization system for minimizing presence of bacteria in areas of proximity to the capsules. In an embodiment, all tubing in the apparatus providing fluid communication between the components described herein are disposable, and in certain embodiments are made of plastic. Said tubing may be easily accessible and removable typically via one hand operation.

The Dosage Form

Dosage forms herein are capsules, typically hard capsules, for pharmaceutical or health and nutrition applications.

Such capsules typically comprise a fill therein when reaching the sealing station described above. Said fill may comprise one or more medicaments and/or excipients therein in solid (e.g. powder-like) and/or liquid form (at room temperature conditions).

The capsules typically comprise: a cap and a body each comprising an outer surface and an inner surface, the cap and body being arranged to telescopically engage with each other such that an overlap region is formed between a portion of the outer surface of the body and a portion of the inner surface of the cap.

In an embodiment the capsules herein are multi-piece capsules comprising a plurality of capsule shells (selected from cap(s) and/or body(s)). The capsule shells may each comprise locking features to mechanically lock with one or more other capsule shells. Said features may comprise a combination of protrusions and recesses of complementary shape such that when interposed lock the capsule shells together.

In certain embodiments the capsules herein, the shells thereof, may be made of, or consist of, an ingestible material comprising materials selected from gelatin, one or more polysaccharides, such as pullulan; nonionic hydrogels, such as cellulose such as hydroxypropyl methylcellulose (HPMC); and mixtures thereof. Most preferred materials being gelatin and/or hydroxypropyl methylcellulose (HPMC). Capsules herein may be non-injection molded, and in certain embodiments made via a dip molding process. The latter ensures high production speeds and cost effectiveness. Other materials may also be used, as will be recognized by one skilled in the art, including cellulose ethers, such as starches (e.g. waxy maize starch, tapioca dextrin, and derivatives thereof), carrageenan, and polymers or copolymers of (meth) acrylic acids and derivatives thereof.

Typically, the cap and body parts may be substantially tubular in shape and each comprise a single opening. The cap and/or body parts described herein may be hard capsule shells.

In an embodiment, the capsules herein are not banded. Such ensures effective sealing whilst maintaining good visual acceptance by subjects of the dosage form.

Examples of particularly suitable capsules for use in apparatus and methods described herein are further exemplified in WO2007/017725A2.

Drug/Medicament

Dosage form articles described herein may comprise one or more drugs. Drugs suitable for use in the dosage forms described herein may take any form and be for any treatment of a human or animal subject. This includes not only pharmaceutical compounds but also dietary supplements such as vitamins, minerals and the like (in certain embodiments incorporated together with other excipients as a capsule fill).

The drug may be in a state selected from solid or liquid, at room temperature and atmospheric pressure, and comprises one or more active compounds. The physical state of said drug is typically wholly dependent on the needs for a given application. When the drug is in solid state the drug may be powder-like or caplet-like (i.e. tablet-like). The drug may be in the form of a caplet or tablet typically having a first and second end.

In most preferred embodiments the capsule fill is liquid.

Suitable compounds for delivery according to the disclosure include, but are not limited to, powder, liquid, and/or pellet forms of the following:

a) pharmaceuticals (also called pharmaceutical actives) such as betamethasone, thioctic \ acid, sotalol, salbutamol, norfenefrine, silymahn, dihydroergotamine, buflomedil, etofibrate, indomethacin, oxazepam, acetyldigitoxins, piroxicam, halopehdol, isosorbide mononitrate, amithptyline, diclofenac, nifedipine, verapamil, pyritinol, nitrendipine, doxy-cycline, bromhexine, methylprednisolone, clonidine, fenofibrate, allopurinol, pirenzepine, levothyroxine, tamoxifen, metildigoxin, o-(B-hydroxyethyl)-rutoside, propicillin, aciclovir-mononitrate, paracetamolol, naftidrofuryl, pentoxifylline, propafenone, acebutolol, 1-thyroxin, tramadol, bromocriptine, loperamide, ketofinen, fenoterol, ca-dobesilate, propranolol, minocycline, nicergoline, ambroxol, metoprolol, B-sitosterin, enalaprilhydro-genmaleate, bezafibrate, isosorbide dinitrate, gallopamil, xantinolnicotinate, digitoxin, flunitrazepam, bencyclane, depanthenol, pindolol, lorazepam, diltiazem, piracetam, phenoxymethylpenicillin, furosemide, bromazepam, flunarizine, erythromycin, metoclo-pramide, acemetacin, ranitidine, biperiden, metamizol, doxepin, dipotassiumchloraze-pat, tetrazepam, estramustinephosphate, terbutaline, captopril, maprotiline, prazosin, atenolol, glibenclamid, cefaclor, etilefrin, cimetidine, theophylline, hydromorphone, ibu-profen, primidone, clobazam, oxaceprol, medroxyprogesterone, flecainide, Mg-pyhdoxal-5-phosphateglutaminate, hymechromone, etofyllineclofibrate, vincamine, cin-narizine, diazepam, ketoprofen, flupentixol, molsidomine, glibornuhde, dimethindene, melperone, soquinolol, dihydrocodeine, clomethiazole, clemastine, glisoxepid, kallidino-genase, oxyfedhne, baclofen, carboxymethylcystsin, thioredoxin, betahistine, 1-tryptophan, myrtol, bromelain, prenylamine, salazosulfapyridine, astemizole, sulpiride, benzerazid, dibenzepin, acetylsalicylic acid, miconazole, nystatin, ketoconazole, sodium picosulfate, colestyramate, gemfibrozil, rifampin, fluocortolone, mexiletine, amoxicillin, terfenadine, mucopolysaccharidpolysulfuric acid, triazolam, mianserin, tiaprofensaure, ameziniummethylsulfate, mefloquine, probucol, quinidine, carbamazepine, Mg-1-aspartate, penbutolol, piretanide, amitriptyline, caproteron, sodium valproinate, mebeverine, bisacodyl, 5-amino-salicyclic acid, dihydralazine, magaldrate, phenprocou-mon, amantadine, naproxen, carteolol, famotidine, methyldopa, auranofine, estriol, nadolol, levomepromazine, doxorubicin, medofenoxat, azathioprine, flutamide, norfloxacin, fendiline, prajmaliumbitartrate, aescin acromycin, anipamil, benzocaine, [beta]-carotene, cloramphenicol, chlorodiazepoxid, chlormadinoneacetate, chlorothiazide, cin-narizine, clonazepam, codeine, dexamethasone, dicumarol, digoxin, drotaverine, grami-cidine, griseofulvin, hexobarbital hydrochlorothiazide, hydrocortisone, hydroflumethiazide, ketoprofen, lonetil, medazepam, mefruside, methandrostenolone, sulfaperine, nalidixic acid, nitrazepam, nitrofurantoin, estradiol, papaverine, phenacetin, phenobarbi-tal, phenylbutazone, phenytoin, prednisone, reserpine, spironolactine, streptomycin, sul-famethizole, sulfamethazine, sulfamethoxoazole, sulfamethoxydiazinon, sulfathiazole, sulfisoxazole, testosterone, tolazamide, tolbutamide, trimethoprim, tyrothricin, antacids, reflux suppressants, antiflatulents, antidopaminergics, proton pump inhibitors, H2-receptor antagonists, cytoprotectants, prostaglandin analogues, laxatives, antispasmodics, antidiarrhoeals, bile acid sequestrants, opioids, beta-receptor blockers, calcium channel blockers, diuretics, cardiac glycosides, antiarrhythmics, nitrates, antianginals, vasoconstrictors, vasodilators, ACE inhibitors, angiotensin receptor blockers, alpha blockers, anticoagulants, heparin, antiplatelet drugs, fibrinolytic, anti-hemophilic factor, haemostatic drugs, hypolipidaemic agents, statins, hypnotics, anaesthetics, antipsychotics, antidepressants (including tricyclic antidepressants, monoamine oxidase inhibitors, lithium salts, selective serotonin reuptake inhibitors), anti-emetics, anticonvulsants, an-tiepileptics, anxiolytics, barbiturates, movement disorder drugs, stimulants (including amphetamines), benzodiazepine, cyclopyrrolone, dopamine antagonists, antihistamines, cholinergics, anticholinergics, emetics, cannabinoids, 5-HT antagonists, analgesics, muscle relaxants, antibiotics, sulfa drugs, aminoglycosides, fluoroquinolones, bronchodilators, NSAIDs, anti-allergy drugs, antitussives, mucolytics, decongestants, corticosteroids, beta-receptor antagonists, anticholinergics, steroids, androgens, antian-drogens, gonadotropin, corticosteroids, growth hormones, insulin, antidiabetic drugs (including sulfonylurea, biguanide/metformin, and thiazolidinedione), thyroid hormones, antithyroid drugs, calcitonin, diphosponate, vasopressin analogs, contraceptives, follicle stimulating hormone, luteinising hormone, gonadotropin release inhibitor, progestogen, dopamine agonists, oestrogen, prostaglandin, gonadorelin, clomiphene, tamoxifen, di-ethylsti I bestrol, antimalarials, anthelmintics, amoebicides, antivirals, antiprotozoals, vaccines, immunoglobulin, immunosuppressants, interferon, monoclonal antibodies, and mixtures thereof;

b) vitamins, e.g., fat-soluble vitamins such as vitamins A, D, E, and K, and water soluble vitamins such as vitamin C, biotin, folate, niacin, pantothenic acid, riboflavin, thiamin, vitamin B6, vitamin B12, and mixtures thereof;

c) minerals, such as calcium, chromium, copper, fluoride, iodine, iron, magnesium, manganese, molybdenum, phosphorus, potassium, selenium, sodium (including sodium chloride), zinc, and mixtures thereof;

d) dietary supplements such as herbs or other botanicals, amino acids, and substances such as enzymes, organ tissues, glandulars, and metabolites, as well as concentrates, metabolites, constituents, extracts of dietary ingredients, and mixtures thereof;

e) homoeopathic ingredients such as those listed in the Homeopathic Pharmacopoeia of the United States Revision Service (HPRS), and mixtures thereof. It must be recognized, of course, that the HPRS is periodically updated and that the present invention includes homeopathic ingredients that may be added to the HPRS; and mixtures in any combination of the foregoing. Medicaments particularly suitable for incorporation into capsules sealed by the apparatus described herein comprise ones typically associated with innate high bio-burden such as live micro-organisms, tissues or the like.

Method

The disclosure further relates to a method for aseptic sealing capsules having coaxial body parts that at least partly overlap when telescopically joined with each other, the method comprising the steps of:

providing a capsule to be sealed;

applying a sealing fluid uniformly to a circumferential gap 10 around said capsule directly followed by suction of any excess sealing fluid, whilst maintaining the capsule in the same and stationary upright position along axis L; and in certain embodiments wherein said steps are carried out by an apparatus 1 as describedherein.

In an embodiment, the sealing step and the suction of excess sealing fluid is carried out when in a fully clamped position, in certain embodiments followed by a second subsequent suction step once the clamp is in a fully open position (this latter step ensuring that any residual sealing fluid on a clamp surface is removed). Typically, the method further comprising a decontamination step wherein when in an un-clamped position, a further suction force is applied such to remove any remaining sealing fluid on a clamp member 5 surface.

In an embodiment, the method further comprises the step of sanitizing the apparatus after sealing a plurality of capsules.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" (i.e. every value in a practical range close to 40 mm).

The invention claimed is:

1. An apparatus for aseptically sealing a capsule having coaxial parts that at least partly overlap when telescopically joined, the apparatus comprising:

a capsule carrier assembly provided with at least one cavity for accommodating a respective capsule therein;

a clamping member comprising a first half and a second half disposed on either side of said at least one cavity at a capsule processing station, and each said half arranged to linearly displace towards said at least one cavity containing said respective capsule to a clamped position over and/or around at least a portion of said respective capsule, wherein the linear displacement of the clamping member is provided by a combination of a rotational drive and a rail member converting a rotational movement to a linear movement along a rail of said rail member, and further wherein the rail member comprises at least two first slots through which a portion of the rotational drive extends in order to engage with each respective clamp half via at least one respective second slot located at a bottom face of each clamp half, each second slot arranged to accommodate said respective portion of the rotational drive, and wherein the first and second slots are elongated in shape with a longest side of the first slots being substantially perpendicular to a longest length of the second slots;

wherein each said half of said clamping member comprises a sealing mechanism adapted to apply a sealing fluid uniformly to a circumferential gap, formed between the coaxial parts, around said respective capsule to be sealed when in said clamped position, and further comprises a suction mechanism adapted to provide an area of low pressure around said respective capsule after application of the sealing fluid so as to remove any excess sealing fluid from said respective capsule when in said clamped position.

2. The apparatus according to claim 1 wherein the capsule carrier assembly comprises a plurality of cavities for accommodating respective capsules therein and each first and second half of the clamping member comprises a plurality of concave recesses each arranged to accommodate a portion of a surface of the respective capsule therein such that when the clamping member is in its fully closed clamped position a plurality of capsules are circumferentially enclosed within said clamping member.

3. The apparatus according to claim 1 wherein the sealing fluid is provided to the clamping member by a pump.

4. The apparatus according to claim 1 wherein the suction mechanism comprises one or more vacuum nozzles in fluid communication with a filter and a vacuum source.

5. The apparatus according to claim 4 further comprising a liquid collection reservoir in fluid communication with the one or more vacuum nozzles and the vacuum source, wherein said liquid collection reservoir comprises an inlet and an outlet, said inlet being downstream the one or more vacuum nozzles and the outlet being upstream the filter, said reservoir being arranged to collect and retain the sealing liquid sucked through the one or more vacuum nozzles under gravitational effect.

6. The apparatus according to claim 4 further comprising a liquid collection reservoir in fluid communication with the one or more vacuum nozzles and the vacuum source, wherein said liquid collection reservoir comprises an inlet and an outlet, said inlet being downstream the one or more vacuum nozzles and the outlet being upstream the filter, said reservoir being arranged to collect and retain the sealing liquid sucked through the one or more vacuum nozzles under gravitational effect, wherein said reservoir is removable and/or disposable.

7. The apparatus according to claim 1 wherein the at least one cavity has open sides to expose a portion of the respective capsule such that each half of the clamping member can wrap around a circumferential surface of the respective capsule, so that once in the clamped position a full circumference of the respective capsule, over at least a portion of the capsule length along a capsule axis (L), is enclosed within said clamping member.

8. The apparatus according to claim 1 arranged such that both sealing and suction occur at a same processing position of the respective capsule without further translating the respective capsule to one or more different processing positions.

9. The apparatus according to claim 1 wherein the sealing mechanism comprises one or more sealing fluid nozzles in fluid communication with a sealing fluid source, and the suction mechanism comprises a plurality of vacuum nozzles in fluid communication with a vacuum source, wherein said sealing fluid and vacuum nozzles are circumferentially spaced around each first and second halves of the clamping member.

10. The apparatus according to claim 9 wherein the plurality of vacuum nozzles comprises a number of vacuum nozzles greater than a number of sealing fluid nozzles of the one or more sealing fluid nozzles.

11. The apparatus according to claim 10 wherein each half comprises more vacuum nozzles than sealing fluid nozzles.

12. The apparatus according to claim 1 wherein the suction mechanism comprises at least 3 vacuum nozzles being radially disposed along a radial clamping surface.

13. The apparatus according to claim 1 wherein the capsule carrier is rotatably mounted onto a stationary frame, the apparatus comprising a plurality of capsule handling stations, and wherein one of said stations is the capsule processing station being a single combined sealing-and-suction station comprising the clamping member.

14. The apparatus according to claim 1 wherein the capsule carrier assembly comprises a plurality of cavities for accommodating respective capsules therein and each first and second half of the clamping member comprises a plurality of concave recesses each arranged to accommodate a portion of a surface of the respective capsule therein such that when the clamping member is in its fully closed clamped position a plurality of capsules are circumferentially enclosed within said clamping member, wherein each half comprises at least 3 concave recesses.

15. The apparatus according to claim 1 wherein the sealing fluid is provided to the clamping member by a peristaltic pump.

16. The apparatus according to claim 1 wherein the suction mechanism comprises one or more vacuum nozzles in fluid communication with a filter and a vacuum source, wherein the filter is positioned between the vacuum nozzles and the vacuum source.

17. A method for aseptically sealing capsules having coaxial body parts that at least partly overlap when telescopically joined with each other, the method comprising the steps of:

providing a capsule to be sealed;

applying a sealing fluid uniformly to a circumferential gap, formed between the coaxial body parts, around said capsule;

suctioning any excess sealing fluid, wherein during the suctioning step, the capsule is in a stationary upright position along a capsule axis (L); and wherein said steps are carried out by an apparatus according to claim 1.

18. A method comprising steps of:

providing capsules having coaxial body parts that at least partly overlap when telescopically joined with each other;

aseptically sealing the capsules by applying a sealing fluid uniformly to a circumferential gap, formed between the coaxial body parts, around the capsule; and suctioning any excess sealing fluid, wherein during the suctioning step, the capsule is in a stationary upright position along a capsule axis (L); and wherein said steps are carried out by an apparatus according to claim 1.

* * * * *